US007033215B2

(12) United States Patent
Kobayashi

(10) Patent No.: US 7,033,215 B2
(45) Date of Patent: Apr. 25, 2006

(54) SEALING PLUG AND A WATERTIGHT CONNECTOR PROVIDED THEREWITH

(75) Inventor: Tomohiko Kobayashi, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 10/730,827

(22) Filed: Dec. 8, 2003

(65) Prior Publication Data

US 2004/0121638 A1 Jun. 24, 2004

(30) Foreign Application Priority Data

Dec. 18, 2002 (JP) ..... 2002-366753

(51) Int. Cl.
*H01R 13/40* (2006.01)

(52) U.S. Cl. ..... 439/587

(58) Field of Classification Search ..... 439/587, 439/274, 275, 271

See application file for complete search history.

(56) References Cited

U.S. PATENT DOCUMENTS 5,351,972 A * 10/1994 Anderberg ..... 277/362
5,562,494 A 10/1996 Fujiwara
5,603,637 A 2/1997 Matsuoka et al.
5,607,318 A 3/1997 Wakata et al.
5,611,706 A * 3/1997 Makita et al. ..... 439/275
5,927,725 A 7/1999 Tabata et al.
6,036,541 A * 3/2000 Koumatsu ..... 439/587
6,244,898 B1 * 6/2001 Suzuki ..... 439/587

FOREIGN PATENT DOCUMENTS

JP 63-3074 9/1988
JP 07-245149 9/1995

* cited by examiner

*Primary Examiner*—Phuong Dinh
(74) *Attorney, Agent, or Firm*—Gerald E. Hespos; Anthony J. Casella

(57) ABSTRACT

A rubber plug (10) is inserted into a cavity (21) of a connector housing (20) after an insulated wire (40) is inserted through a wire insertion hole (11) to provide a watertight seal between an inner wall of the cavity (24) and the insulated wire (40). Frictional resistance between the inner wall of the cavity (24) and the rubber plug (10) is larger than the frictional resistance between the insulated wire (40) and the rubber plug (10). The frictional resistance between the insulated wire (40) and the rubber plug (10) permits movement of the insulated wire (40) relative to the rubber plug (10) when the insulated wire (40) is caused to expand in longitudinal direction by heat.

9 Claims, 5 Drawing Sheets

SEALING PLUG AND A WATERTIGHT CONNECTOR PROVIDED THEREWITH

BACKGROUND OF THE INVENTION

1. Field of the Invention

The invention relates to a sealing plug to be used in a watertight connector and to a watertight connector provided with such sealing plug.

2. Description of the Related Art

Japanese Unexamined Utility Model Publication No. S63-3074 and FIG. 7 herein disclose a rubber plug used in a watertight connector. With reference to FIG. 7, the rubber plug 1 closely holds an insulated wire 2 inserted therethrough. The watertight connector includes a housing 3 with a rear surface and a cavity 4 that extends into the rear surface. The plug 1 is insertable into the cavity 4. The plug 1 is formed with a plurality of outer rips 5 that can be brought into close contact with the inner wall of the cavity 4. The rubber plug 1 is fixed to a terminal filling 6 by crimping a barrel 7 of the terminal fitting 6 to the front end of the rubber plug 1. The terminal filling 6 is inserted into the cavity 4 and held in position by a resiliently deformable lock 8 formed in the cavity 4. As a result, the rubber plug 1 engages the inside of the cavity in a watertight manner.

The insulated wire 2 may be displaced backward in the cavity 4 by the repeated expansion and elongation of a covering resin of the insulated wire 2 in a heat-cycle environment. The rubber plug 1 is mounted closely on the insulated wire 2 and may be displaced back in the cavity 4 with the insulated wire 2. Thus, some of the outer lips may come out of the cavity 4 to impair a sealing property.

The invention was developed in view of the above problem and an object thereof is to maintain the sealing property of a sealing plug.

SUMMARY OF THE INVENTION

The invention relates to a sealing plug for a watertight connector. The sealing plug has at least one wire insertion hole through which a wire is to be inserted. Additionally, the sealing plug is insertable into a cavity of a connector housing to provide watertight sealing between the inner wall of the cavity and the wire. Frictional resistance between the inner wall of the cavity and the sealing plug is set larger than the frictional resistance between the wire and the sealing plug. Additionally, the frictional resistance between the wire and the sealing plug is set to permit movement of the wire relative to the sealing plug when the wire is moved, such as when the wire expands and elongates longitudinally due to heat. As a result, movement of the sealing plug relative to the cavity in response to movement of the wire can be suppressed. Thus, the sealing plug is prevented from coming out, thereby maintaining good sealing.

At least one outer lip preferably is formed on the outer surface of the sealing plug for closely contacting the inner wall of the cavity, and at least one inner lip preferably is formed on the inner circumferential surface of the sealing plug for closely contacting the wire. A degree of deformation of the outer lip preferably is larger than a degree of deformation of the inner lip. As a result, a larger frictional resistance can be obtained between the outer lip and the inner wall of the cavity.

The number of outer lips may exceed the number of inner lips so that the total frictional resistance between the inner wall of the cavity and the outer lips exceeds the total frictional resistance between the wire and the inner lips.

The one or more outer lips may be aligned substantially with the one or more inner lips.

A fine embossed pattern may be formed in a contact surface of the sealing plug with the inner surface of the cavity. Thus, a larger friction resistance can be obtained between the outer lips and the inner wall of the cavity.

The outer contact surface of the sealing plug with the cavity preferably is made of a material having a higher specific frictional resistance than the inner contact surface of the sealing plug with the wire.

The invention also relates to a watertight connector comprising a housing with at least one cavity into which the above-described sealing plug is insertable. A mirror finish preferably is applied to at least part of the inner wall of the cavity.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
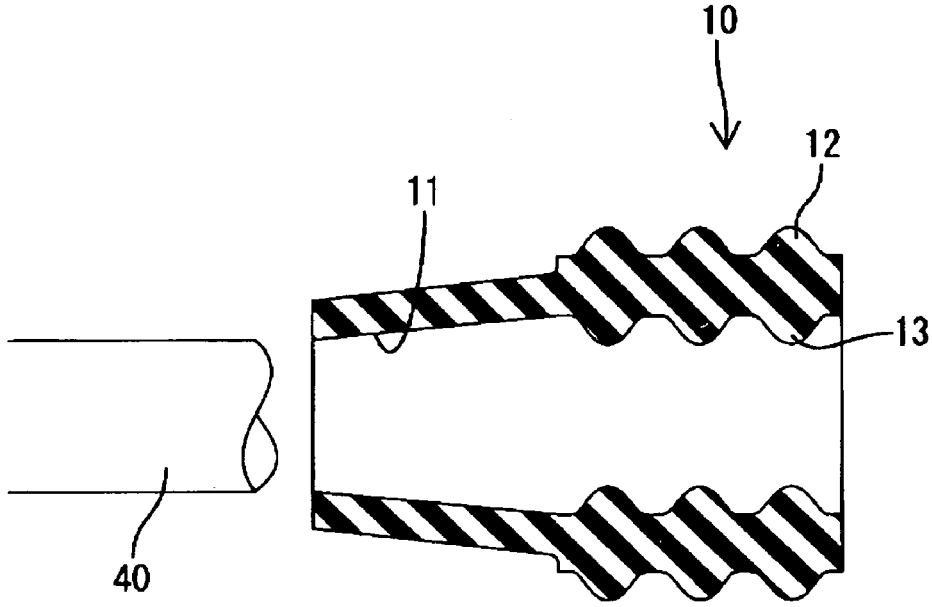
FIG. 1 is a section of a rubber plug according to a first preferred embodiment of the invention.
Figure 2:
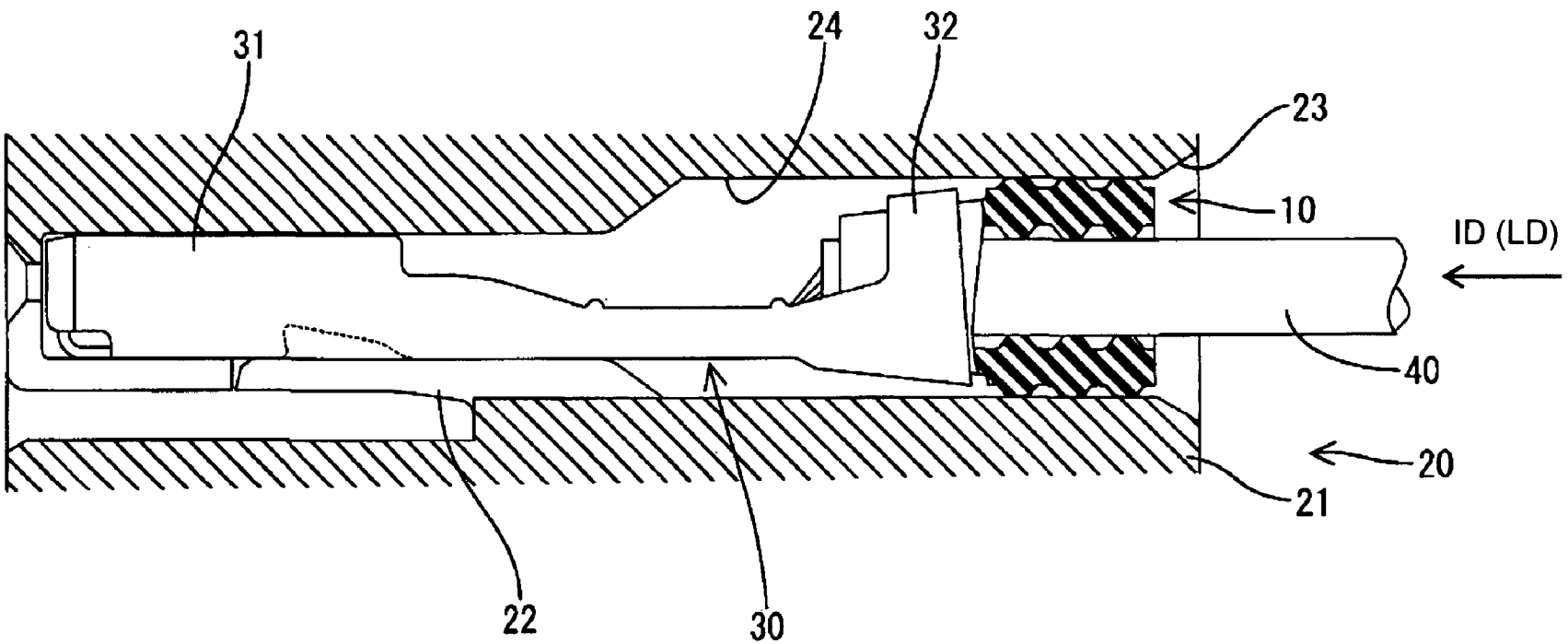
FIG. 2 is a section showing the rubber plug in a cavity.
Figure 3:
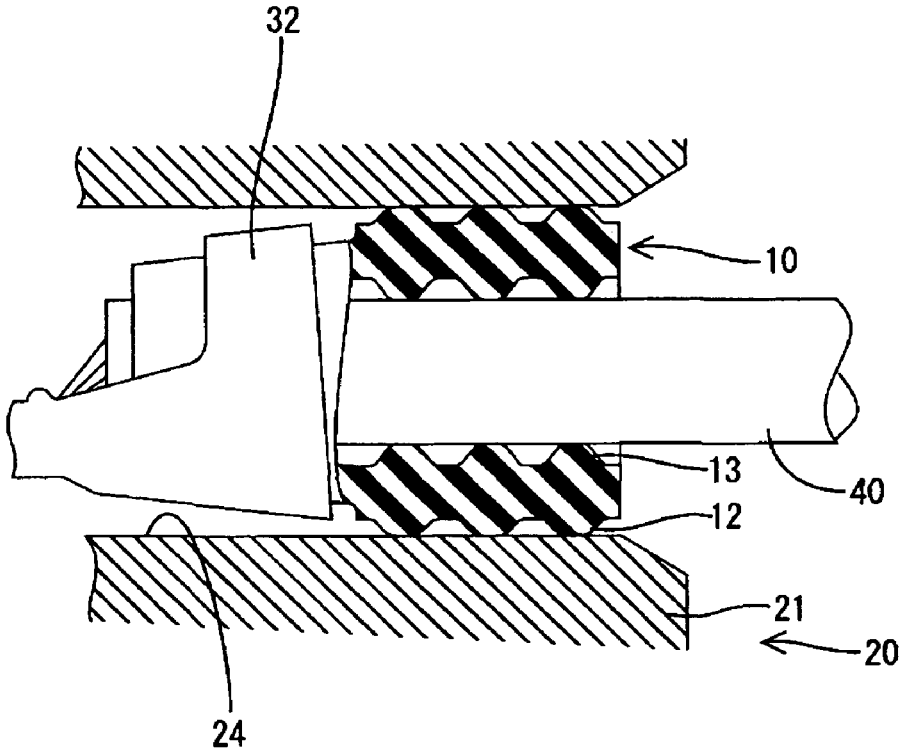
FIG. 3 is an enlarged section of the plug in the cavity.

A first embodiment of a rubber plug according to the invention is identified by the numeral 10 in FIGS. 1 to 3. The rubber plug 10 is mounted in watertight connector 20 that has a housing 21 made e.g. of a synthetic resin. The housing 21 has at least one cavity 24 with a resin lock 22. A terminal insertion opening 23 is made at the rear end, which is the right end in FIG. 2. A female terminal fitting 30 is inserted into the cavity 24 and is locked by the resin lock 22. A mirror finish is applied to at least part of the inner wall of the cavity 24 for reducing surface roughness and for improving the sealing property of the rubber plug 10.

The terminal fitting 30 is inserted into the cavity 24 through the terminal insertion opening 23. As a result, the resin lock 22 engages a substantially box-shaped engaging portion 31 towards the front of the terminal fitting 30 for locking the terminal fitting 30 in the cavity 24. An unillustrated mating connector can be connected with the terminal fitting 30 so that a male tab of the mating connector is inserted into the box-shaped engaging portion 31 of the terminal fitting 30 to achieve electrical connection. A wire crimping portion 32 is formed at the rear end of the terminal fitting 30. The wire crimping portion 32 is crimped, bent or folded into connection with the front end of an insulated wire 40 and the front end of the rubber plug 10 mounted on the outer circumferential surface of the insulated wire 40 in a watertight manner. In this case, an overlap crimping method is utilized so that the wire crimping portion 32 is crimped to overlap and protect the rubber plug 10.

The rubber plug 10 preferably is made of a silicone or similar resilient material. A wire insertion hole 11 is formed inside the rubber plug 10 and extends substantially in forward and backward directions, as shown in FIG. 1. Circumferentially extending outer lips 12 are formed on the outer surface of the rubber plug 10 and are spaced apart along the insertion direction ID. Similarly, circumferentially extending inner lips 13 are formed on the inner surface of the wire insertion hole 11 and are spaced apart along the insertion direction ID. The outer lips 12 are at substantially the same longitudinal positions as the inner lips 13.

The outer diameter of the outer lips 12 is substantially larger than the inner diameter of the portion of the cavity 24 where the rubber plug 10 is to be positioned. Thus, the outer lips 12 are held in close contact with the inner wall of the cavity 24 and are compressed or deformed when the rubber plug 10 is inserted into the cavity 24. On the other hand, the inner diameter of the inner lips 13 is slightly smaller than or substantially equal to the outer diameter of the insulated wire 40. Thus, the outer lips 12 deform more than the inner lips 13 when the rubber plug 10 is inserted into the cavity 24, and a low frictional resistance is created between the inner lips 13 and the insulated wire 40. As a result, the insulated wire 40 can move relative to the rubber plug 10 due to expansion and elongation of the wire 40 in the longitudinal direction LD due, for example, to the influenced of heat.

The insulated wire 40 is inserted along the insertion direction ID and is held in the wire insertion hole 11 of the rubber plug 10 and the wire crimping portion 32 is crimped into connection with the insulated wire 40 and the rubber plug 10. The rubber plug 10 in this state is fitted into the cavity 24 in the insertion direction ID, following the terminal fitting 30. The rubber plug 10 is inserted to a proper insertion position where the terminal fitting 30 is locked by the resin lock 22 to complete the insertion operation. In this state, the outer lips 12 are compressed and/or deformed while being held in close contact with the inner wall of the cavity 24 and the inner lips 13 are held substantially in close contact with the insulated wire 40 as shown in FIG. 3. As a result, a good sealability is displayed between the insulated wire 40 and the rubber plug 10 and between the rubber plug 10 and the cavity 24.

In the prior art, there is not a large difference between a total contact area of the outer lips 12 with the cavity 24 and a total contact area of the inner lips 13 with the insulated wire 40 since the degree of deformation of the outer lips 12 substantially equals the degree of deformation of the inner lips 13. However, in this embodiment, the total contact area of the outer lips 12 with the cavity 24 is considerably larger than the contact area of the inner lips 13 with the insulated wire 40 (preferably more than about 1.5 times larger, more preferably more than about two times, most preferably more than about three times). This difference in contact area is achieved by setting the degree of deformation or compression of the outer lips 12 to exceed the degree of deformation or compression of the inner lips 13. As a result, frictional resistance between the outer lips 12 and the cavity 24 exceeds the frictional resistance between the inner lips 13 and the insulated wire 40. Additionally, the resilient pressure exerted by the outer lips 12 on the inner wall of the cavity 24 may be larger that the resilient pressure of the inner lips 13 on the wire 40 so that the frictional resistance of the outer lips 12 is higher than the frictional resistance of the inner lips 13. It should be noted that the degree of deformation is a difference between a projecting height of the lips in a natural state and a projecting height when the lips are compressed in the cavity 24.

The watertight connector 20 may be exposed to a heat-cycle environment. Thus, a polyethylene resin of the insulation coating of the wire 40 expands in the longitudinal direction LD. As a result, the insulated wire 40 moves relative to the rubber plug 10 because the frictional resistance between the inner lips 13 and the insulated wire 40 is low. On the other hand, the outer lips 12 closely contact the inner wall of the cavity 24 during the movement of the insulated wire 40 because the frictional resistance between the outer lips 12 and the cavity 24 is high. As a result, the rubber plug 10 is prevented from coming out of the cavity 24, thereby ensuring a good sealing property.

Figure 4:
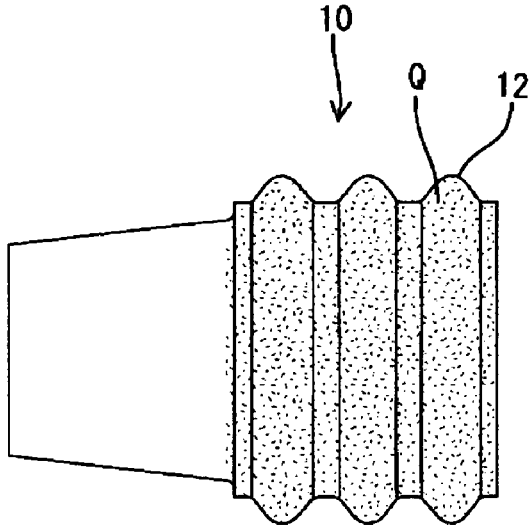
FIG. 4 is a side view of a rubber plug according to a second preferred embodiment.

FIG. 4 shows a second embodiment where a treatment is applied to the outer circumferential surface of the rubber plug 10 to increase the frictional resistance. More specifically, a surface treatment, such as embossing, is applied to at least parts of the outer lips 12 to be held in contact with the inner wall of the cavity 24. The surface treatment defines a fine embossed pattern Q comprising small protrusions. In this way, the frictional resistance between the outer lips 12 and the inner wall of the cavity 24 is increased to suppress movement of the rubber plug 10 in response to movement of the insulated wire 40. In this embodiment, the fine embossed pattern Q is made at substantially the entire outer circumferential surface of the rubber plug 10.

Figure 5:
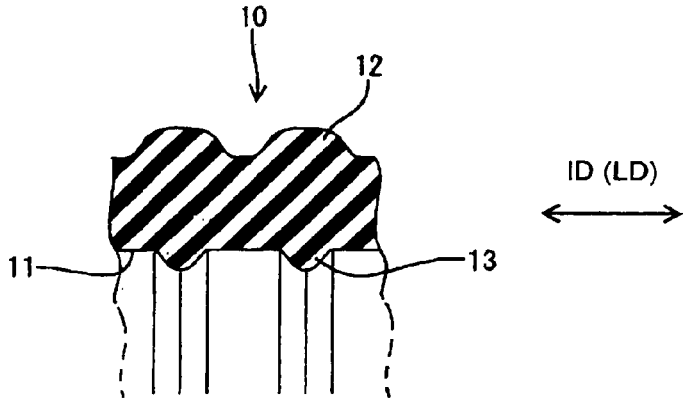
FIG. 5 is a section enlargedly showing a particular portion of a rubber plug according to a third preferred embodiment.
Figure 6:
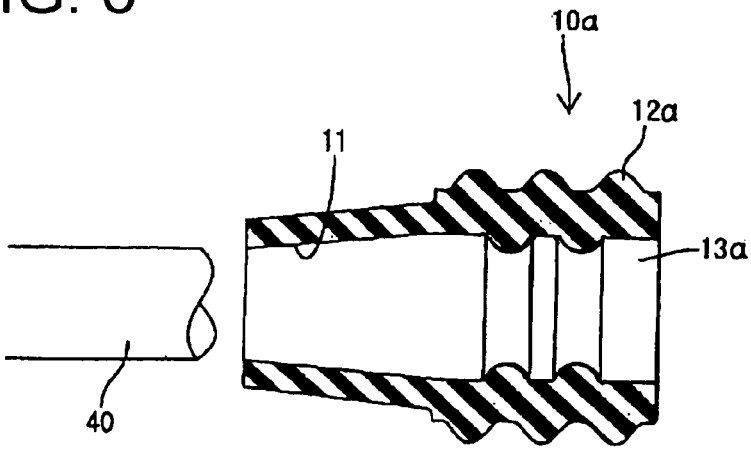
FIG. 6 is a cross-sectional view similar to FIG. 1 but showing a fourth embodiment.
Figure 7:
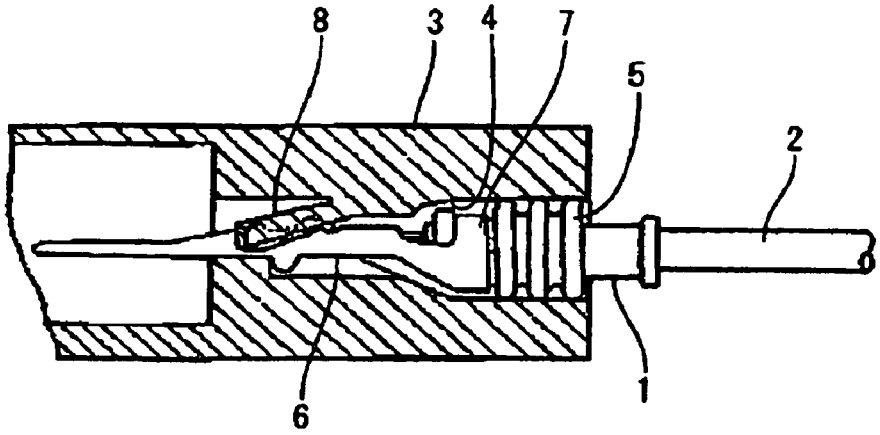
FIG. 7 PRIOR ART
FIG. 7 is a side view of a prior art rubber plug.

FIG. 5 shows a third embodiment where the outer lips 12 that contact the inner wall of the cavity 24 are elongated in the longitudinal direction LD to increase the contact area. However, the inner lips 13 that contact the insulated wire 40 are shortened in the longitudinal direction LD to reduce the contact area. Thus, the frictional resistance between the inner lips 13 and the insulated wire 40 is reduced while the frictional resistance between the outer lips 12 and the inner wall of the cavity 24 is increased. FIG. 6 shows an embodiment where a rubber plug 10*a* has more outer lips 12*a* than inner lips 13*a*. Thus, the frictional resistance between the inner lips 13*a* and the insulated wire 40 is lower than the frictional resistance between the outer lips 12*a* and the inner wall of the cavity.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The rubber plug may be a block rubber plug formed with wire insertion holes for the respective insulated wires so that a plurality of insulated wires can be inserted therethrough.

The rubber plug may be formed in two colors of different materials at its inner and outer sides.

The rubber plug may be mounted on a male terminal fitting.

It should be understood that the frictional resistance created between the inner wall of the cavity 24 and the sealing plug 10 can be set larger than the frictional resistance created between the wire 40 and the sealing plug 10 by other means such as by providing more outer lips 12 than inner lips 13, by modifying the surface configuration of the inner and/or outer lips with suitable coatings, co-molding methods of other materials so that the material of the outer surface of the rubber plug differs from the inner surface.

What is claimed is:

1. A sealing plug for a watertight connector, the sealing plug being formed with at least one wire insertion hole through which a wire is to be inserted, and being at least partly insertable into a cavity of a connector housing to provide a watertight sealing between an inner wall of the cavity and the wire, the cavity having a selected inside diameter and the wire having a selected outside diameter, wherein:

at least one outer lip is formed on an outer surface of the sealing plug for contact with the inner wall of the cavity and at least one inner lip is formed on an inner surface of the sealing plug for contact with the wire, the inner and outer lips having substantial identical sizes and shapes when viewed along a cross-section taken centrally through the wire insertion hole before the seal is mounted on the wire and in the cavity, the outer lip having an outside diameter and the inner lip having an inside diameter, the outside diameter of the outer lip and the inside diameter of the inner lip being selected relative to the inside cross-sectional dimension of the cavity and the outside diameter of the wire so that a degree of deformation of the outer lip is larger than a degree of deformation of the inner lip for achieving a frictional resistance between the inner wall of the cavity and the sealing plug that is larger than a frictional resistance between the wire and the sealing plug, and so that the frictional resistance between the wire and the sealing plug is set to permit a movement of the wire relative to the sealing plug when the wire is caused to move.

2. The sealing plug of claim 1, wherein there are more of the outer lips than the inner lips so that a total frictional resistance between the inner wall of the cavity and the outer lips exceeds a total frictional resistance between the wire and the inner lips.

3. The sealing plug of claim 1, wherein the outer lips and the inner lips are substantially aligned.

4. A sealing plug for a watertight connector, the sealing plug being formed with at least one wire insertion hole through which a wire is to be inserted, and being at least partly insertable into a cavity of a connector housing to provide a watertight sealing between an inner wall of the cavity and the wire, wherein:

a fine embossed pattern being formed on at least part of a contact surface of the sealing plug with the inner surface of the cavity so that a frictional resistance between the inner wall of the cavity and the sealing plug is larger than a frictional resistance between the wire and the sealing plug, and the frictional resistance between the wire and the sealing plug is set to permit a movement of the wire relative to the sealing plug when the wire is caused to move.

5. A sealing plug for a watertight connector, the sealing plug being formed with at least one wire insertion hole through which a wire is to be inserted, and being at least partly insertable into a cavity of a connector housing to provide a watertight sealing between an inner wall of the cavity and the wire, wherein:

a frictional resistance between the inner wall of the cavity and the sealing plug is larger than a frictional resistance between the wire and the sealing plug, and the frictional resistance between the wire and the sealing plug is set to permit a movement of the wire relative to the sealing plug when the wire is caused to move, wherein an outer contact surface of the sealing plug with the cavity is made of a material having a higher specific frictional resistance than an inner contact surface of the sealing plug with the wire.

6. A watertight connector assembly comprising:

a housing having at least one cavity extending therethrough, the cavity having a selected inside diameter;

a wire having a selected outside diameter that is less than the inside diameter of the cavity, at least a portion of the wire being in the cavity; and a sealing plug having an outer surface with at least one outer lip defining a selected outside diameter greater than the inside diameter of the cavity before the sealing plug is mounted in the cavity, the sealing plug further having a wire insertion hole extending therethrough and formed with at least one inner lip defining an inside diameter that is less than the outside diameter of the wire before the wire is mounted in the wire insertion hole, the inner and outer lips having substantially similar shapes and substantially identical sizes when viewed along a cross-section taken centrally through the insertion hole and before mounting the seal to the housing and the wire, the wire being passed through the wire insertion hole of the sealing plug and the seating plug being inserted into the cavity so that the sealing plug is sealed to both the wire and the cavity, a difference between the outside diameter of the outer lips and the inside diameter of the cavity being greater than a difference between the inside diameter of the inner lip and the outside diameter of the wire so that the outer lips deform more than the inner lips when the plug is inserted in the cavity and so that a lower frictional resistance is created between the inner lips and the wire than between the outer lips and the cavity.

7. The connector assembly of claim 6, wherein the plurality of outer lips is substantially equal in number to the plurality of inner lips.

8. The connector assembly of claim 7, wherein the inner lips are substantially aligned opposite from the outer lips.

9. The connector assembly of claim 6, wherein a projecting distance of each outer lip on the outer surface of the sealing plug is substantially equal to a projecting distance of each inner lip from the inner surface of the sealing plug.

* * * * *